US006848214B2

(12) United States Patent
Bischof et al.

(10) Patent No.: US 6,848,214 B2
(45) Date of Patent: Feb. 1, 2005

(54) MOVABLE WALL SYSTEM HAVING A PLURALITY OF MOVABLE PANELS, A RUNNER RAIL, AND A TRACKING-SWITCHING ARRANGEMENT

(75) Inventors: Markus Bischof, Altenrhein (DE); Stefan Rechsteiner, Staad (DE)

(73) Assignee: Dorma GmbH + Co. KG, Ennepetal (DE)

( * ) Notice: Subject to any disclaimer, the term of this patent is extended or adjusted under 35 U.S.C. 154(b) by 89 days.

(21) Appl. No.: 10/051,620

(22) Filed: Jan. 18, 2002

(65) Prior Publication Data

US 2002/0152685 A1 Oct. 24, 2002

Related U.S. Application Data

(63) Continuation-in-part of application No. PCT/EP01/05730, filed on May 18, 2001.

(30) Foreign Application Priority Data

May 19, 2000 (DE) ..... 100 24 580

(51) Int. Cl.[7] ..... E05D 15/26
(52) U.S. Cl. ..... 49/127; 49/409
(58) Field of Search ..... 49/409, 125, 127, 49/128, 130

(56) References Cited

FOREIGN PATENT DOCUMENTS

| | | |
|---|---|---|
| DE | 1659879 | 10/1969 |
| DE | 1957004 | 8/1973 |
| DE | 4015870 | 11/1991 |

*Primary Examiner*—Gregory J. Strimbu
(74) *Attorney, Agent, or Firm*—Nils H. Ljungman & Associates

(57) ABSTRACT

Movable wall that comprises a plurality of panels, each panel of which is mounted by means of at least one suspension device having a guide roller from a runner rail so that it can move in the runner rail, which runner rail comprises at least one running surface on which the runner rollers lie. The at least one suspension device comprises lateral guidance means for the suspension device or parts thereof, by which the runner rollers are held in the running surface in the direction of movement. The runner rail has at least one junction at which the suspension device of the panel is steered in a predetermined manner into a direction of movement on the running surface, whereby the truck has only one carrier roller and one guidance roller, and that the guide roller actuates a junction in the form of a switchable switch which has a pivoting running surface for the carrier roller.

20 Claims, 13 Drawing Sheets

MOVABLE WALL SYSTEM HAVING A PLURALITY OF MOVABLE PANELS, A RUNNER RAIL, AND A TRACKING-SWITCHING ARRANGEMENT

CONTINUING APPLICATION DATA

This application is a continuation-in-part of International Application No. PCT/EP01/05730, filed on May 18, 2001, which claims priority from Federal Republic of Germany Application No. 100 24 580.3, filed on May 19, 2000. International Application No. PCT/EP01/05730 was pending as of the filing date of this application. The United States was an elected state in International Application No. PCT/EP01/05730.

BACKGROUND OF THE INVENTION

1. Field of the Invention

This invention relates to a movable wall comprising a plurality of movable panels for use in a building to divide rooms or areas into separate spaces. The panels are suspended on suspension devices from a rail structure attached to a ceiling or other building structure. The suspension devices have rollers to allow the panels to be moved along the rail. In movable walls of this type, the panels may be designed to be moved manually, or the panels may be automatically moved by an automatic panel drive unit. The rail structure can be designed to split or branch off in multiple directions so that the panels can be moved into various positions.

This invention further relates to a runner rail for a movable wall system that comprises a plurality of panels, each panel of which is mounted by means of at least one suspension device. The suspension device has a guide roller associated with the runner rail so that it can move in the runner rail. The runner rail has at least one running surface on which runner rollers lie, with lateral guidance means for the suspension device or parts thereof, by which the runner rollers are held in the running surface in the direction of movement. The runner rail has at least one junction at which the suspension device of each panel is steered in a predetermined manner into a direction of movement on the running surface.

2. Background Information

German Patent No. 40 15 870 A1 describes a runner rail of the prior art for use with a movable wall, the panels of which are mounted in the runner rail so that they can be pushed. The suspension device thereby has runner rollers that are associated with the rail. The runner rail comprises two separate running surfaces and guide means associated with each of them. Each running surface and the corresponding guide means are formed by a profiled rail, on which the runner rollers of the associated suspension devices sit, and each of which is adapted to match the profile of the rail. For this purpose, the runner rollers have wheel flanges and are thereby guided laterally by the rail. The runner rollers are also each mounted in the suspension devices so that they can rotate around a horizontal axis and carry the panels that are fastened to them, thereby forming a part of the suspension device. The runner rail is thereby provided with two rails and at least one junction, whereby one rail runs through the junction in a first direction and the other rail runs through the junction in a second direction. Each direction of displacement is therefore associated, ahead of and behind the junction of the runner rail, with a rail, and thus with a running surface. Therefore each panel must be movably mounted according to its predetermined direction of displacement on the associated rail of the runner rail. One disadvantage of this design is that it is very complex, expensive and inflexible. For example, if a panel is to be moved in any direction other than its originally intended direction, the entire suspension device must be modified and the panel must be hung on the other rail of the runner rail. A large number of component structures are also necessary, namely suspension devices for the rail that is associated with one direction of movement and suspension devices for the rail that is associated with the other direction of movement.

German Patent No. 16 59 879 A1 describes a mobile partition, the individual horizontally movable wall elements of which are supported on the floor side and are only guided on the ceiling side. Consequently, the wall elements are not suspended, and to that extent there are no ceiling-side suspension devices with corresponding running surfaces. There is a lateral stabilization and guidance that is provided by the ceiling rail, whereby the corresponding guide wheels for the determination of the direction of travel also slide along outside a rigid junction at a different height in the side walls of the ceiling rail.

German Patent Publication Published for Opposition Purposes No. 19 57 004 describes a device for the segmental movement of rail pieces that are located on a ceiling switch and for the optional connection of intersecting or crossing segments of runner rail. Devices of this type are used for portions of movable walls, among other things. To actuate the movable rail pieces, switching lugs of swiveling switch pockets project into the corresponding rail segments. As a result of the passage of the wall elements which are suspended on the trucks, the individual rail segments can be pivoted as appropriate and can thus actuate a revolving switch accordingly.

OBJECT OF THE INVENTION

An object of the invention is to develop an improved movable wall comprising a plurality of movable panels for use in a building to divide rooms or areas into separate spaces that substantially overcomes the disadvantages of the prior art discussed above.

Another object of the invention is to develop and improve a runner rail for a movable wall system as described above in the "Field of the Invention" so that, while eliminating the disadvantages described above, a simple and above all flexible construction can be manufactured at an economical cost.

SUMMARY OF THE INVENTION

The object of the invention may be achieved in a movable wall comprising a plurality of movable panels for use in a building to divide rooms or areas into separate spaces. The panels can be suspended on suspension devices from a rail structure attached to a ceiling or other building structure. The suspension devices may have rollers to allow the panels to be moved along the rail. In movable walls of this type, the panels may be designed to be moved manually, or the panels may be automatically moved by an automatic panel drive unit. The rail structure can be designed to split or branch off in multiple directions so that the panels can be moved into various positions.

The invention further teaches that this object is accomplished in a runner rail for a movable wall system that comprises a plurality of panels, each panel of which is mounted by means of at least one suspension device. The suspension device has a guide roller associated with the runner rail so that it can move in the runner rail. The runner rail has at least one running surface on which runner rollers lie, with lateral guidance means for the suspension device or parts thereof, by which the runner rollers are held in the running surface in the direction of movement. The runner rail has at least one junction at which the suspension device of each panel is steered in a predetermined manner into a direction of movement on the running surface. Each panel has a truck that has only one carrier roller and one guidance roller. The guide roller actuates a junction in the form of a switchable switch which has a pivoting running surface for the carrier roller. Additional embodiments of the teaching of the invention are disclosed in the embodiments of the invention described herein below.

The runner rail of the partition system described above has only one running surface, which means that both a front and a rear truck of a partition that is fastened to the suspension device of the trucks are supported on the same runner rail, and can therefore be moved by means of horizontally mounted rotating rollers. Therefore the same profiles of the runner rail can be used both for the area of junctions and also in straight segments.

In the upper portion on each of the trucks there is only one guide roller which consists of a cylindrical roller. Depending on the desired direction of travel of a truck, the roller is placed in one position for straight travel or in another position for travel through a junction.

To further explain, the guide roller of the trucks is placed in one of two positions on the upper portion of the truck. If the truck is to travel along a particular portion of the runner rail or track, the guide roller is placed in a position on the truck such that it does or does not actuate a track-switching arrangement during travel along the track. In an additional possible embodiment, any type of projection or structure could be connected to the truck in place of or in conjunction with the guide roller to actuate a switch. For example, a projecting bar or other extension could be attached to project from the truck. The projecting bar could be positioned to contact the switch during travel to actuate a junction in the runner rail to permit the truck to travel along the path made available by the actuation of the switch. On trucks where it is not desired to actuate the switch, the projecting device would not be attached.

As a result of this type of construction it is possible to create a type of switch in the vicinity of a junction which consists of only a few components and with an appropriate placement is also switched mechanically by the guide rollers and is thus moved.

When a switch of this type is actuated, for example, a portion of the guide rail which is not present, for example, in the area of a junction, is folded down and thus gives the appropriately coded truck the capability of crossing this segment. The actuation of the switch is thereby achieved by a switching piece. The switching piece consists essentially of an intermediate piece which is preferably fabricated from a bent piece, with switching points connected to each end. These switching points, however, are not connected with the intermediate piece rigidly, but are connected with the intermediate piece by means of correspondingly flexible connections.

To further explain, in different configurations of a movable wall or partition system, it may become necessary to move various panels to different positions on a single track or guide rail. In at least one embodiment of the present invention, there is a junction area on the track or runner rail. At the junction area, the track essentially can split off in two sections, preferably a straight section and a curved section that curves away from the straight section. The junction can permit at least one panel to be moved on the curved section, while permitting at least one other panel to move on the straight section. In at least one embodiment, the straight section is separated by a gap from the main track. The main track continues into the curved section without interruption. In this configuration, the panels therefore will always travel along the curved path because the straight path is inaccessible due to the gap, but this is undesirable. To make the straight section accessible for travel by the panels, a pivoting track portion can be attached to the guide rail at the gap. The pivoting track portion can have essentially the same profile as the guide rail, and can be positioned to be pivoted to fill the gap, thus bridging the gap between the straight section and the main track. This design is advantageous because only one pivoting track portion is necessary to permit panels to travel on either section.

To differentiate between the panels that continue along the straight path and the panels that move along the curved path, the trucks of the corresponding panel may be coded. This means that the trucks have a configuration that determines along which path they and their corresponding panels will travel. For example, the trucks, as discussed above, may have guide rollers that serve to guide the truck along the guide rail. The guide rollers can be positioned to either contact or not contact the track-switching arrangement. For example, if a panel is designated as being one that is to travel on the straight section via the pivoting track portion, the guide roller of the truck of that panel is positioned on the truck so that it will contact the track-switching arrangement. When the guide roller contacts the track-switching arrangement during travel of the panel, the pivoting track portion pivots into alignment with the straight section and the main track to connect the two. The truck then is able to travel on the pivoting track portion and into the straight section. After the truck leaves the pivoting track portion, it returns to its position of disengagement from the straight section and the main track. On the other hand, if a panel is designated as being one that is to travel along the curved section, the guide roller is positioned on the truck so as to not contact the track-switching arrangement. The truck will therefore pass by the track-switching arrangement without actuating it and continue traveling on the curved section. This type of arrangement also works when panels are traveling from the straight section or the curved section to the main track.

The entire switching piece is thereby mounted so that when it is actuated by a guide roller, it effects a pivoting of a running surface for the runner roller of the trucks. This action is preferably accomplished by fastening the switching piece to a connecting piece, on the other end of which there is a lever system that effects a parallel displacement according to the parallelogram principle. In turn, the pivoting running surface is connected to the lever system, so that when the dimensions are appropriately coordinated, and when the guide roller is actuated, the switching piece is actuated so that the pivoting running surface is pivoted into the direction of travel and thus into the area of the runner roller, and thus closes the gap between the junction part of the runner rail and the straight part of the runner rail.

To further explain, the track-switching arrangement can be connected to the pivoting track portion. The track-switching arrangement has a switching or contact piece that can be physically contacted by the guide roller. In one possible embodiment of the present invention, the guide roller presses against the switching piece as it rolls along to displace the switching piece from its normal position. By displacing the switching piece, a first connecting piece connected to the switching piece is also displaced. The first connecting piece can be connected to a second connecting piece which is positioned essentially parallel to and below the first connecting piece. The pivoting track portion is connected to each of the connecting pieces by a corresponding pivoting joint. When the first connecting piece is displaced, it in turn can displace an end of the pivoting track portion. By displacing the end of the pivoting track portion, the pivoting track portion is caused to pivot about the pivoting connection in the second connecting piece in a lever-like movement. The running surface of the pivoting track portion is thus pivoted into alignment with the running surface of the straight section and the main track. After the guide roller and truck exit the pivoting track portion, they cease to engage the switching piece. The connecting pieces can be biased with a spring or other biasing arrangement to apply a force to move the connecting pieces. After the guide roller disengages from the switching piece, the biasing force moves the connecting pieces and thus the pivoting track piece back out of alignment with the straight section and the main track.

In another possible embodiment of the present invention, the movable track piece may be either pivotable or translatable. The track piece may be moved into position by pivoting, as discussed above, or it may be moved into position by a translating motion.

When the switching piece is not actuated by the runner roller, the pivoting running surface is moved out of the area of the running surface of the runner rail, so that in this case no movement by a truck is possible. As a result of this type of construction, there is an automatic, tamper-proof ability to bring such running surfaces into the area of the trucks by coding. A device of this type for use with runner rails can be used both on manually movable and on automatically movable wall elements.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with references to the exemplary embodiments, portions of which are illustrated schematically in the accompanying drawings, in which.

DESCRIPTION OF THE PREFERRED EMBODIMENT

Figure 1:
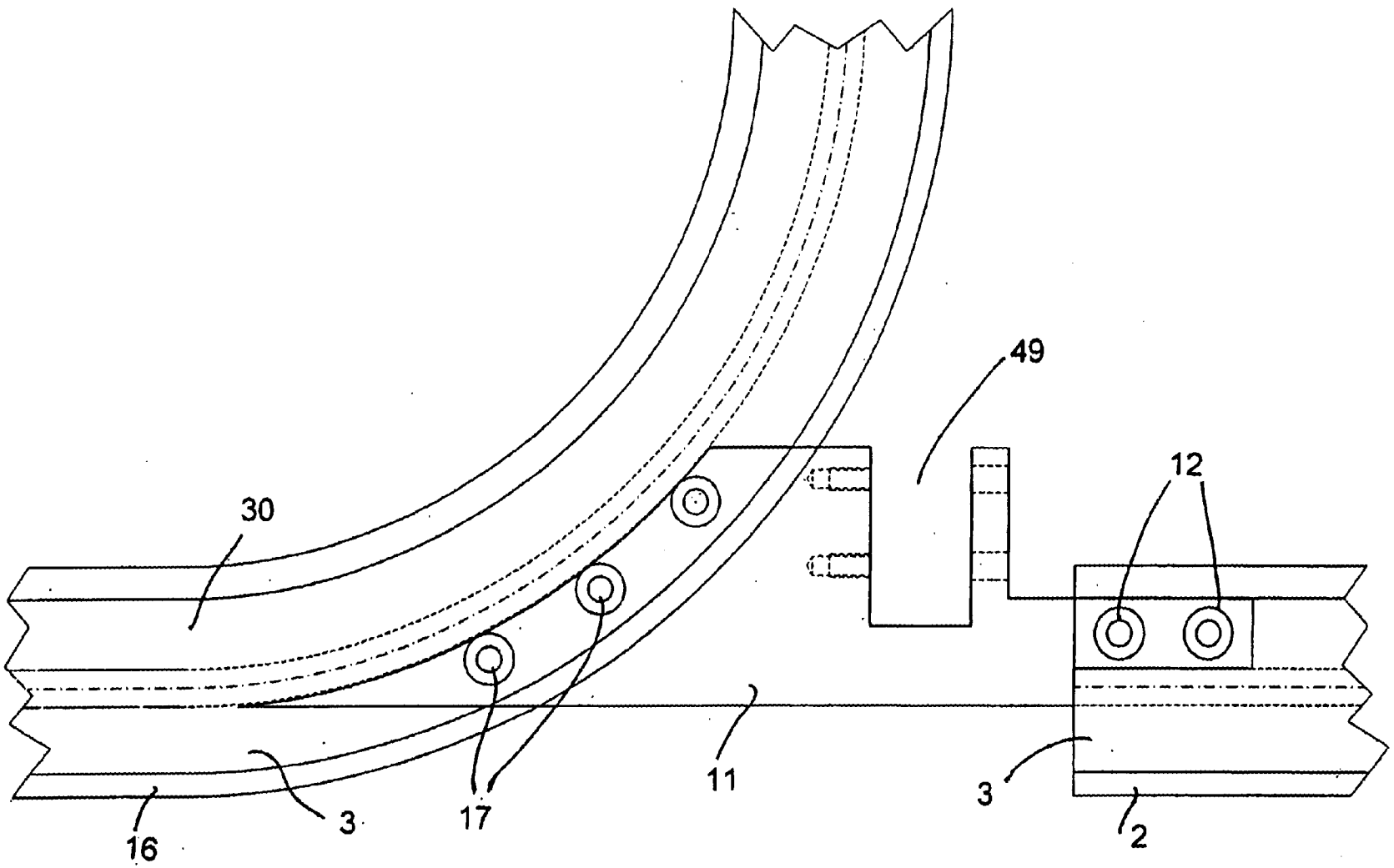
FIG. 1 shows a portion of a curved runner rail and a straight runner rail which are connected by a connecting piece.

FIG. 1 is a schematic illustration that shows the arrangement of a curved runner rail 16 and a straight runner rail 2. The runner rail 16 and the runner rail 2 are connected to each other for mechanical stabilization by means of a connecting piece 11 and on one hand by means of fasteners 12 on the runner rail 2 and on the other hand by means of fasteners 17 on the runner rail 16. The connecting piece 11 is located above the runner rail and thus in no way interferes with the displacement of trucks 4 with panels 1 that are fastened to them. In addition to the connection between the straight portion 2 of the runner rails and the curved portion 16, the connecting piece 11 has the task of holding the device required for this area, namely a pivoting switch. This switch is held in a recess 49, in which both a spacer 27 and a spacer 35 are placed so that they are suspended and can move in rotation.

Figure 2:
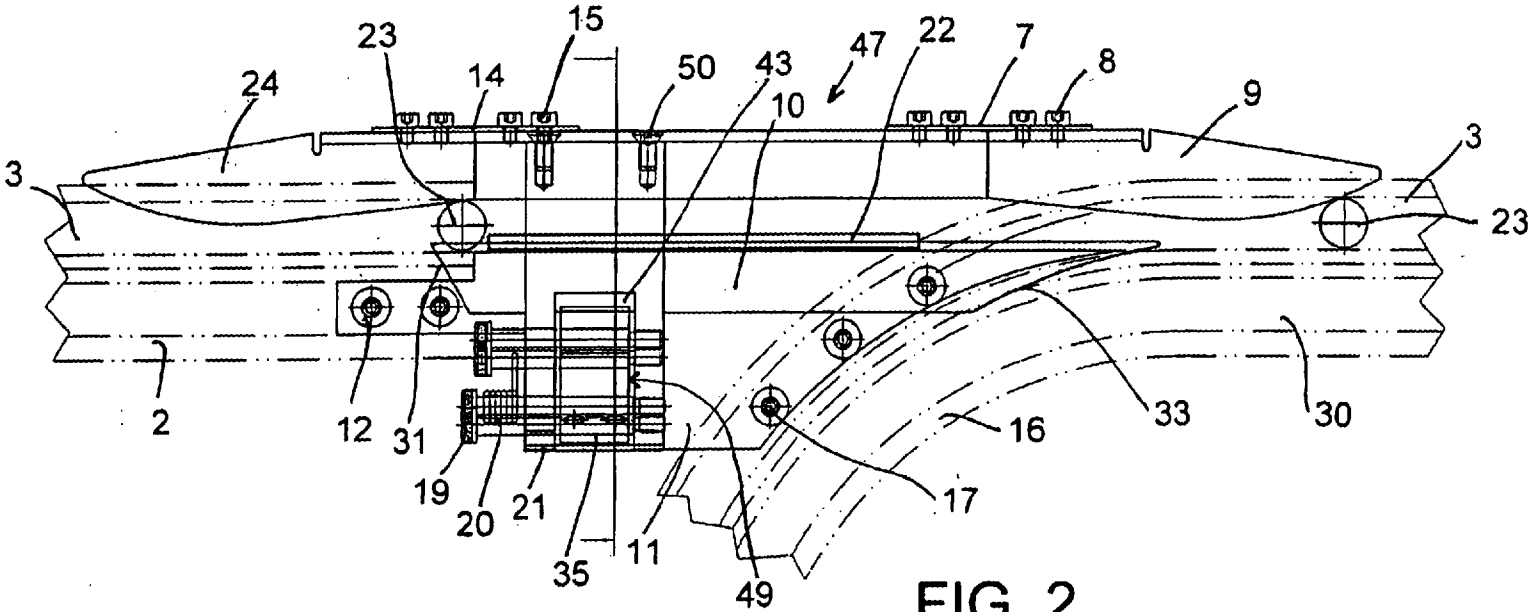
FIG. 2 shows a schematic diagram of the sequence of events in the vicinity of a switch, in a plan view from overhead.

In FIG. 2 there is likewise a connecting piece 11 with the runner rail segments 2 and 16, and also shows the parts that contain a functional device of a switch.

The switching area consists on one hand of a switching piece 47 and a pivoting running surface 10. The switching piece 47 and the running surface 10 are thereby functionally connected by the spacers 35 and 27. The operation of this arrangement is explained in greater detail below.

Figure 8:
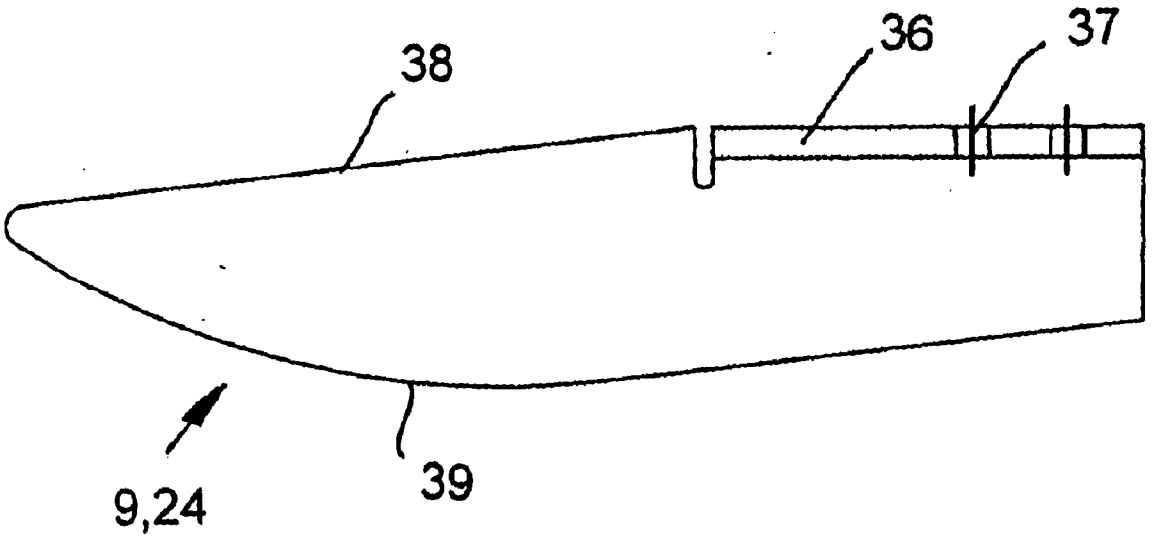
FIG. 8 shows one embodiment of a switching point in a head-on view.
Figure 8A:
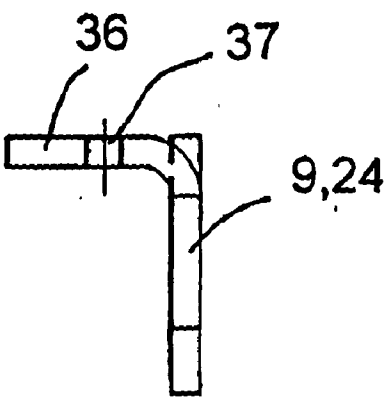
FIG. 8*a* shows same as FIG. 8, but in a side view.
Figure 9:
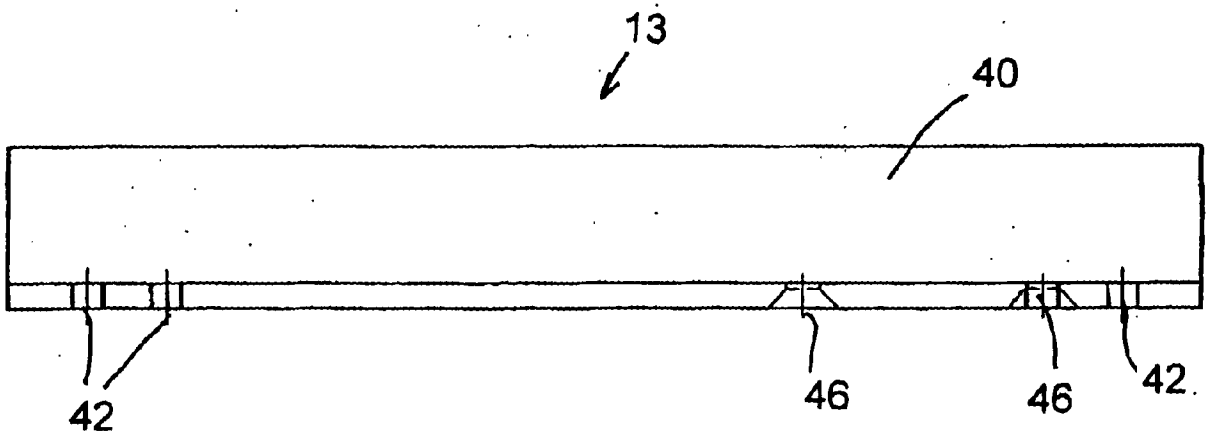
FIG. 9 shows a head-on view of an intermediate piece.
Figure 9A:
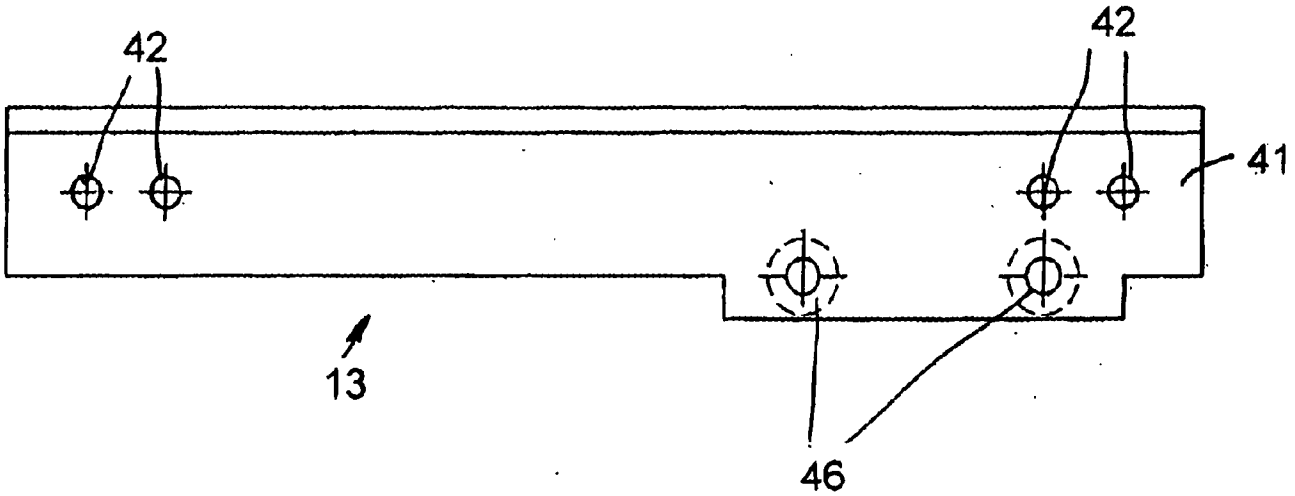
FIG. 9*a* shows a plan view from overhead of an intermediate piece as illustrated in FIG. 9.
Figure 10:
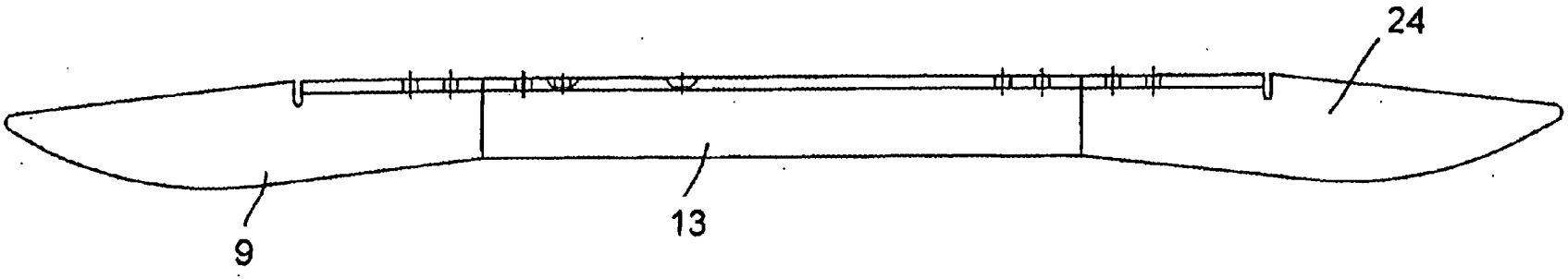
FIG. 10 shows a switching piece with the switching points set.

The switching piece 47 which is illustrated in FIG. 10 and details of which are illustrated in FIGS. 8, 9 and 9*a* consists essentially of an intermediate piece 13, connected to each end of which are switching points 9 and 24. The intermediate piece 13 is thereby formed from an elbow piece with a first leg 40 and a second leg 41. While the leg 40 is used for stabilization and also for the running of a guide roller, the leg 41 has fastening holes 42 and fastening holes 46. Connected to the fastening holes 42, as shown in FIG. 2, are spring steel sheets 7 and 14 by means of the connecting elements 15 shown there, which are secured by means of a positive and non-positive connection of the switching points 9 and 24 through the holes 37 with the holes 42. Thus there is a connection of the switching points 9 and 24 to the intermediate piece 13. The points 9 and 24 are flexibly fastened by the spring steel sheets 7 and 14. If, as shown in FIG. 2, a guide roller 23 of a truck 4 runs onto the switching point 9, as a result of the automatic connection of the switching point 9 via the intermediate piece 13, the running surface 10 pivots into the running area of a runner roller 48. The points 9 and 24 are realized so that they have a projecting area with a rounded portion 39 which projects toward the end of the leg 40 of the intermediate piece 13. So that there is no interference with the entry process when the points 9 and 24 bend, the points 9 and 24 have a beveled portion 38, which is opposite the rounded portion 39. So that the points 9 and 24 perform an appropriate stabilizing function and are also resistant to distortion, they have, in a continuation of the beveled portion 38, an portion 36 that is bent at an angle and simultaneously contains the fastening holes 37.

The switching points 9 and 24 have therefore been designed to be flexible, so that there can be a secure switching of the switches in all cases when the guide roller 23 enters. As a result of the flexible arrangement via the spring steel sheets 7 and 14, the running surface 10 is securely pressed against the existing runner rails 2 and 3. The guide roller 23 thereby runs in a first guide channel 3. If the guide roller 23 has left the area of the point 9 in FIG. 2, namely the right-hand area, and is moving toward the left-hand area, the truck 4 can continue to move as a result of the pivoting of the runner surface 10, because the runner roller 48 can continue to run on the pivoted runner surface 10. In the area of the running surface 10, there is no guide channel 3 in the area of the intermediate piece 13, either in the runner rail 2 or in the runner rail 16. The guidance function for the guide roller 23 is performed by the contour of the switching points 9 and 24 and the leg 40 of the switching piece 47. When the runner roller 48 leaves the pivoted area of the running surface 10, the guide roller has also reached the area of the point 24, and is received by the guide channel located there. For the reliable running of the runner roller 48 on the runner rail 2, here, too, the switching point 24 is also located with the entrance area (rounded portion) 39 inside the guide path of the runner roller 23, so that as a result of the automatic guidance of the runner roller 23, the switching point can also flex outward and thereby guarantee a secure contact of the running surface 10 against the running surfaces of the runner rails.

Figure 7:
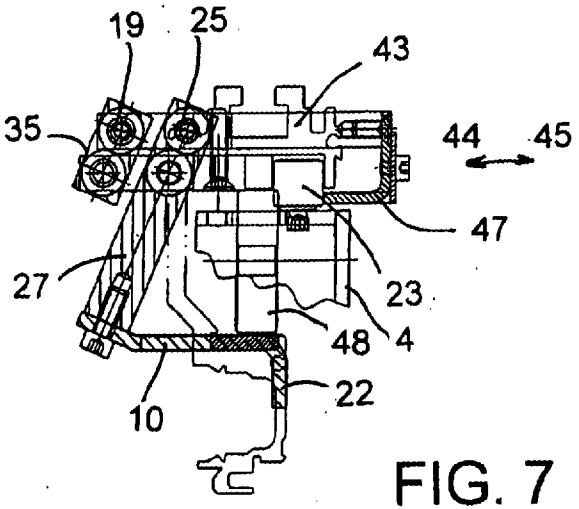
FIG. 7 shows same as FIG. 6, but with an illustration of a portion of a truck with guide and runner rollers.

The situation as it is illustrated in FIG. 2 is shown even more clearly in a side view in FIG. 7. The switching piece 47 is thereby connected by means of fasteners 50 to a flat connecting piece 43 that lies crossways. Connecting bolts 19 and 25 are introduced into the connecting piece 43 by means of borings. These connecting bolts 19 and 25 are also connected with the connecting bolts designated 19 and 25, which are located on the stationary lower portion, and thus inside the recess 49 of the connecting piece 11. The connecting piece 43 can be moved in the directions 44 and 45 on account of the guide roller 23, whereby the spacers 27 and 35 are connected to the connecting piece 43. The spacers 35 and 27 are connected to the stationary part of the connecting piece 11 according to the principle of a parallelogram. As a result of the displacement of the connecting piece 43, there is thus a parallel displacement of the connections 19, 25 with respect to the connections that are located underneath in the connecting piece 11. The spacer 35 is significantly shorter than the spacer 27. Adjacent to the spacer 27 is the pivoting running surface 10. For stabilization, the pivoting running surface 10 also has a bent portion 22 on its free end.

Figure 3:
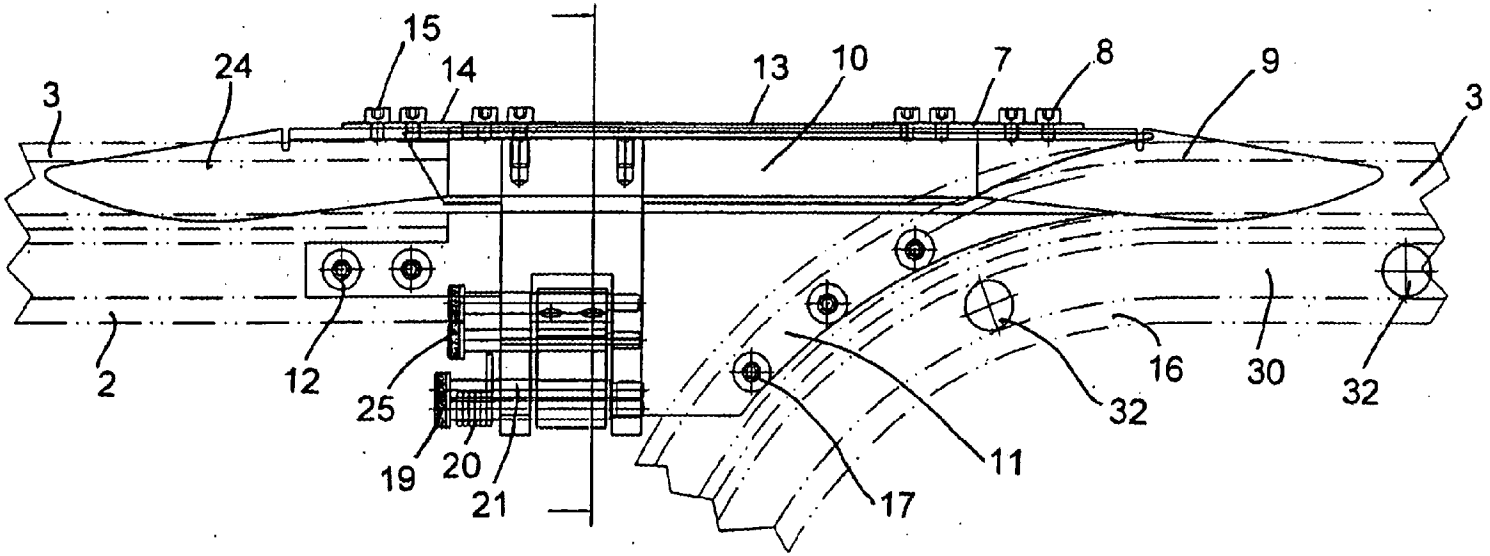
FIG. 3 shows the vicinity of an unactuated switch in a plan view from overhead.
Figure 4:
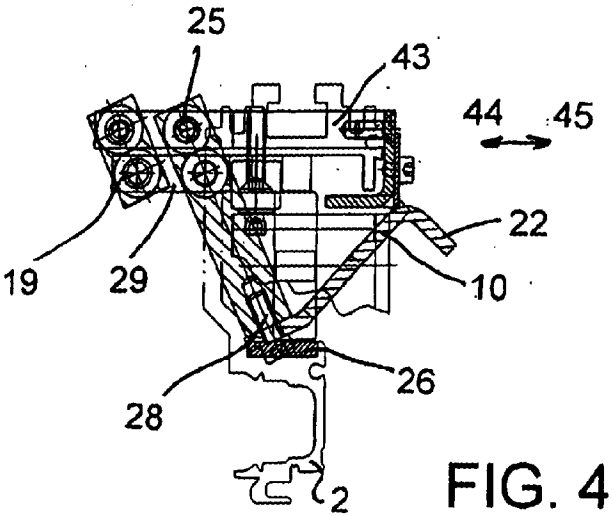
FIG. 4 shows same as FIG. 3, but in a side view.

The exemplary embodiment illustrated in FIG. 3 shows that a guide roller 32 can be run into a second guide channel 30 which is located inside the curved runner rail 16. It is therefore clear that the device for the switch area need not be activated, because the guide rollers 32 cannot come into contact with the switching point 9. Therefore, as illustrated in FIG. 4; there is no pivoting of the running surface 10. The running surface 10 is thus folded down out of the vicinity of a running surface 26 of the guide rail 2.

Figure 5:
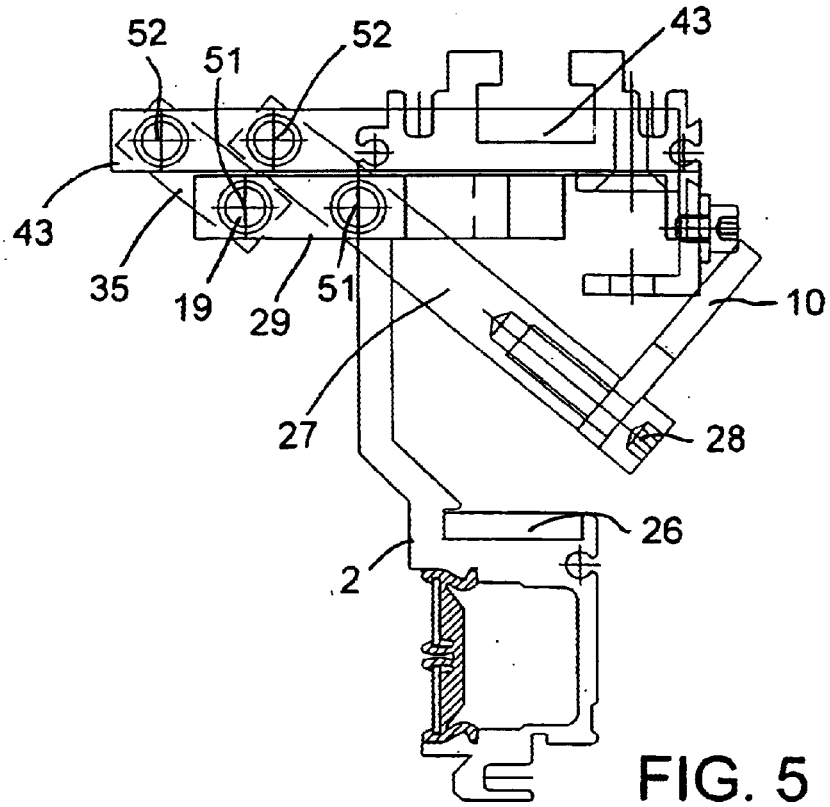
FIG. 5 shows an enlarged illustration of the pivoting area of the running surface, in the unactuated state.
Figure 6:
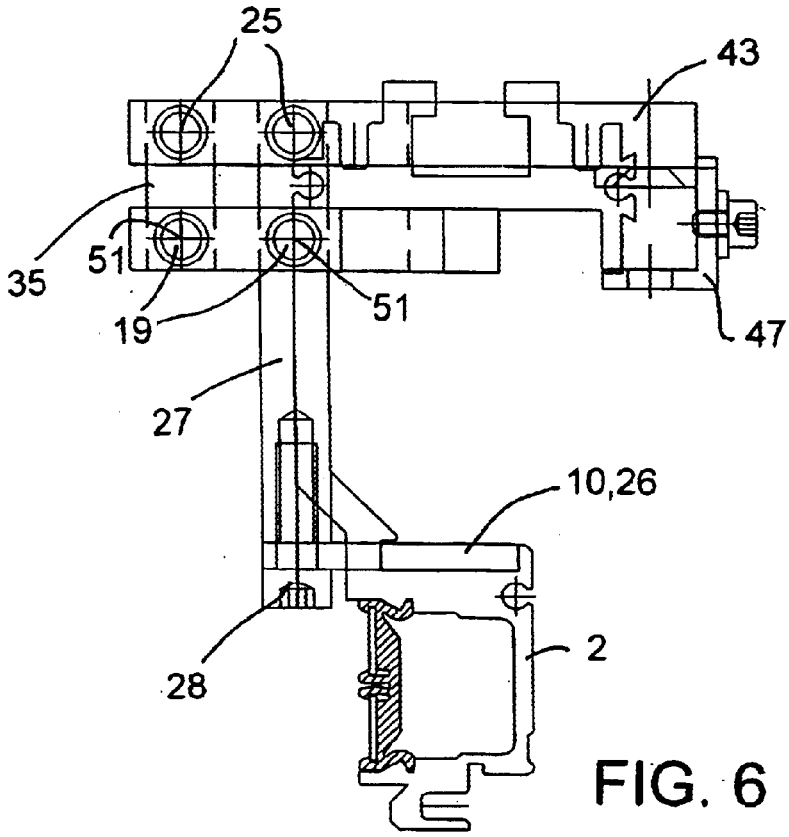
FIG. 6 shows same as FIG. 5, in the actuated state.

This pivoting of the running surface 10 is shown again in FIGS. 5 and 6, in which most of the components not used here have been omitted. The pivot points 51, as shown in FIGS. 5 and 6, are stationary and the pivot points 52 which are located inside the connecting piece 43 can move in the form of a parallel displacement. It is therefore guaranteed that the running surface 10 that is in contact with the spacer 27 by means of a connecting bolt 28 can be pivoted into the vicinity of the running surface 26, as shown in FIG. 6. So that even without an additional device the running surface 10 can be pivoted out of the area of the running surface after the guide roller leaves, spring elements 20 are attached to the connecting bolts 25. By means of the force settings, it is therefore possible to regulate the corresponding return force for the running surface 10.

On account of the arrangement of the device for the switch area it is clear that in connection with the realization of the trucks 4, each of which has only one carrier roller and one guide roller, there is no need for an otherwise conventional second runner rail that comes into play only after a junction area. This arrangement results in an enormous cost saving. The pivoted part 10 of the runner surface is therefore inserted in recesses in the runner rails 2 and 16 respectively.

The sequence of operation of the pivoting device is shown once again in perspective in FIGS. 11 to 14.

Figure 11:
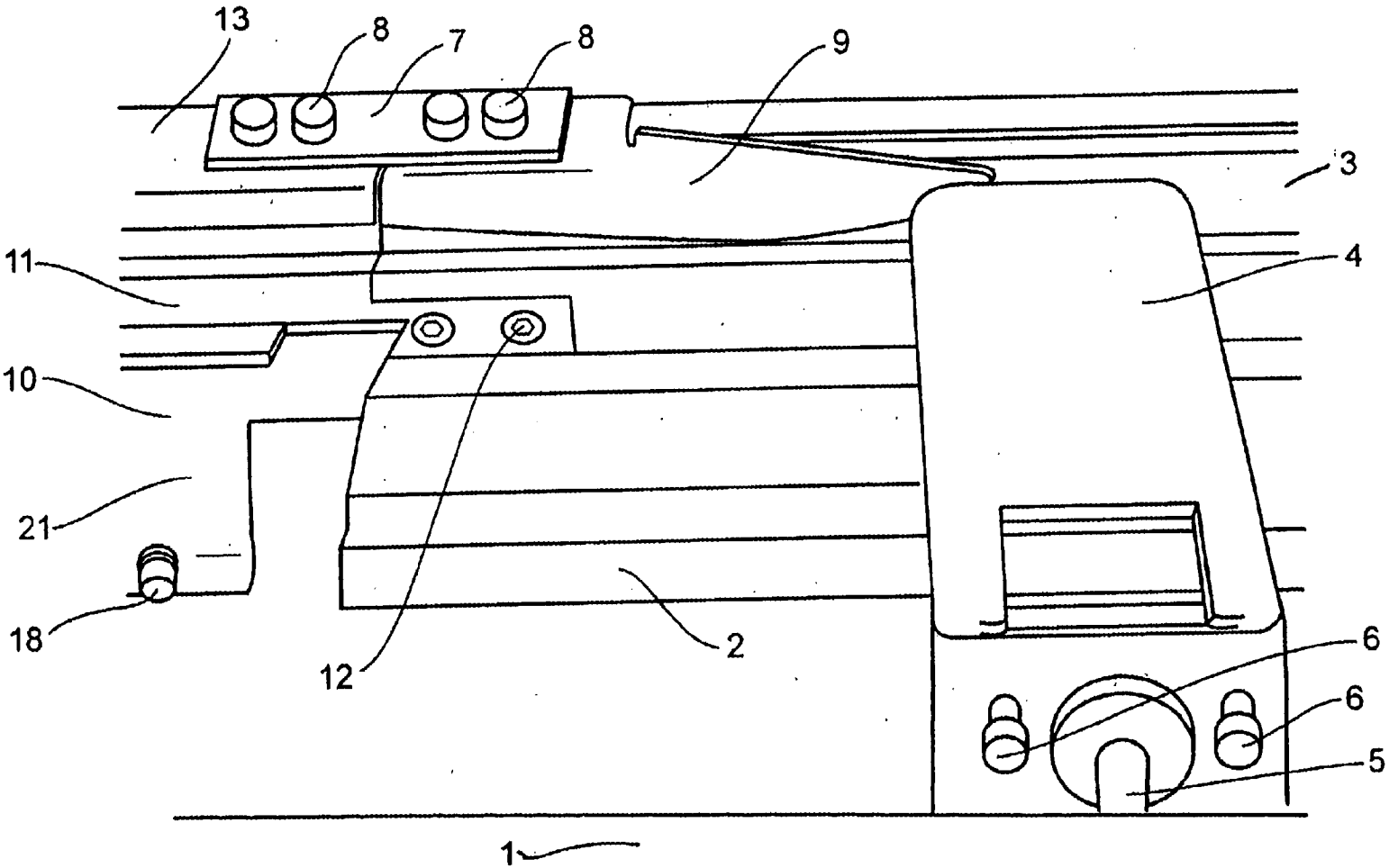
FIG. 11 shows a detail of an arrangement of one straight and one curved runner rail with a truck approaching a switching point.
Figure 12:
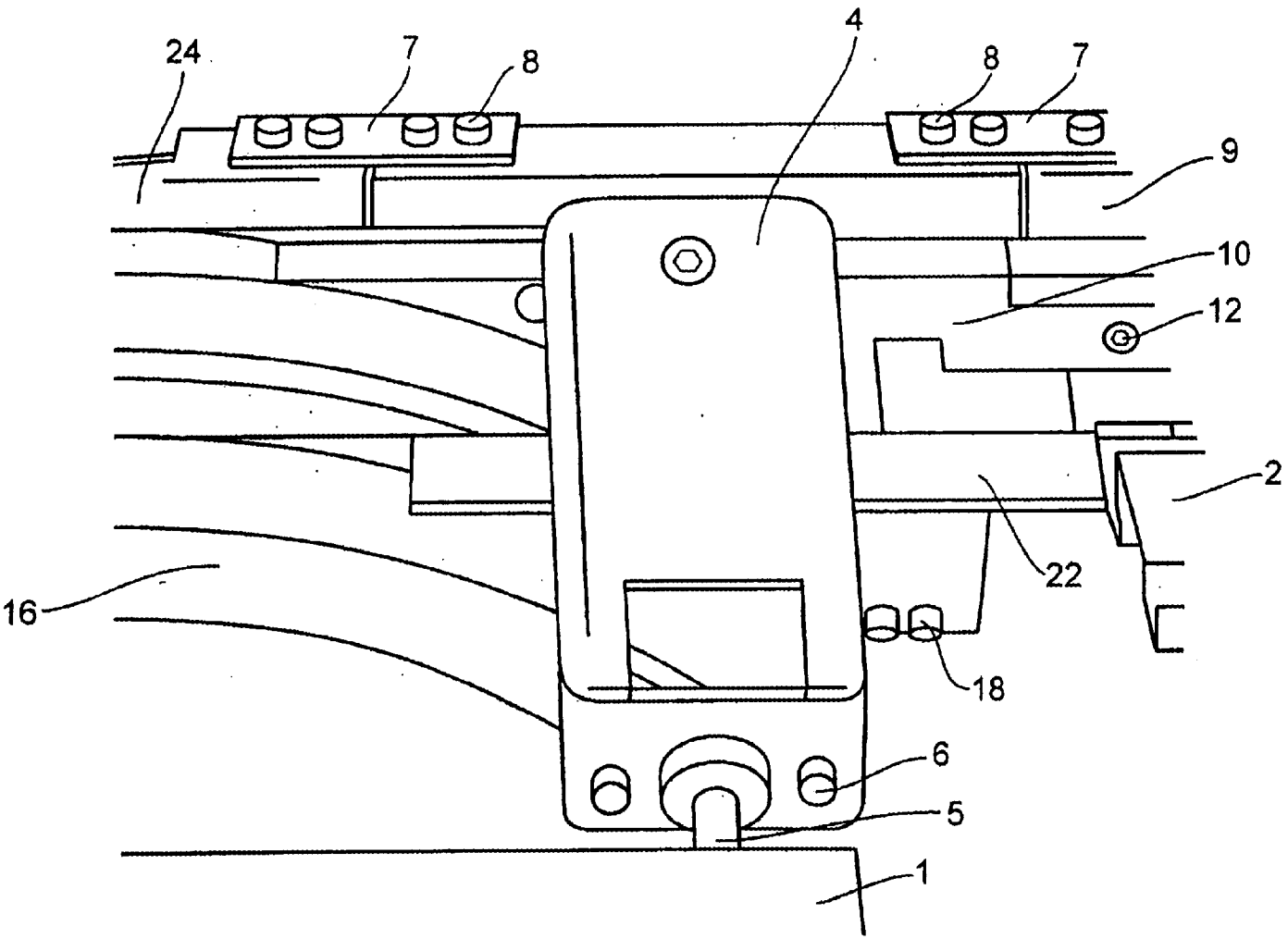
FIG. 12 shows with a truck which has entered the vicinity of the switching piece and with the running surface folded down.

FIG. 11 shows, on the right side, the truck 4, to which the panel 1 is connected by means of a panel suspension. The panel suspension device is adjustably fastened to the truck 4 by means of the panel fasteners 6. The guide roller of the truck 4 is not visible in this illustration. The guide roller has not yet actuated the switching point 9, because the pivoting running surface 10 has not been pivoted into the runner area.

Figure 13:
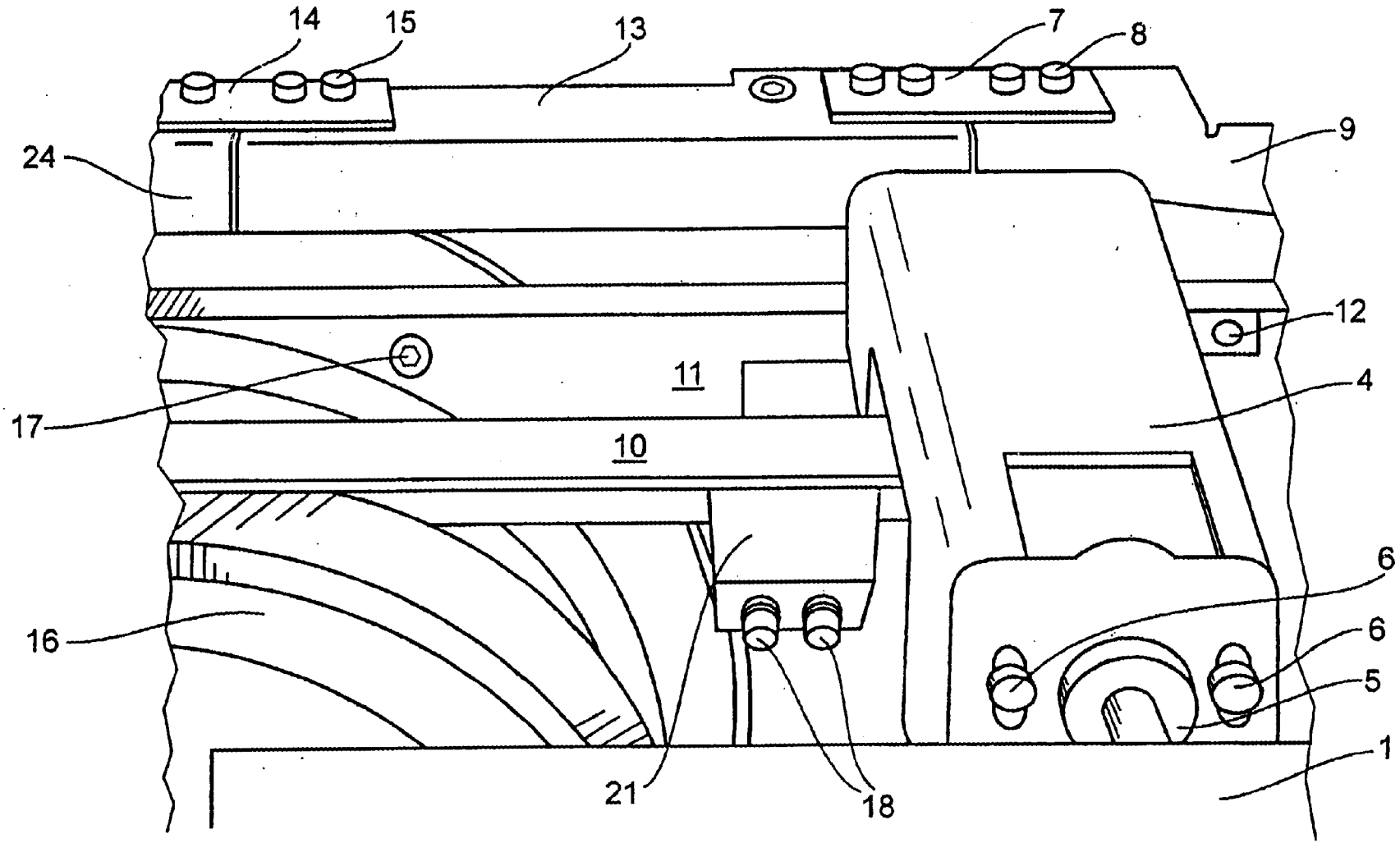
FIG. 13 shows same as FIG. 12, but viewed from another angle.
Figure 14:
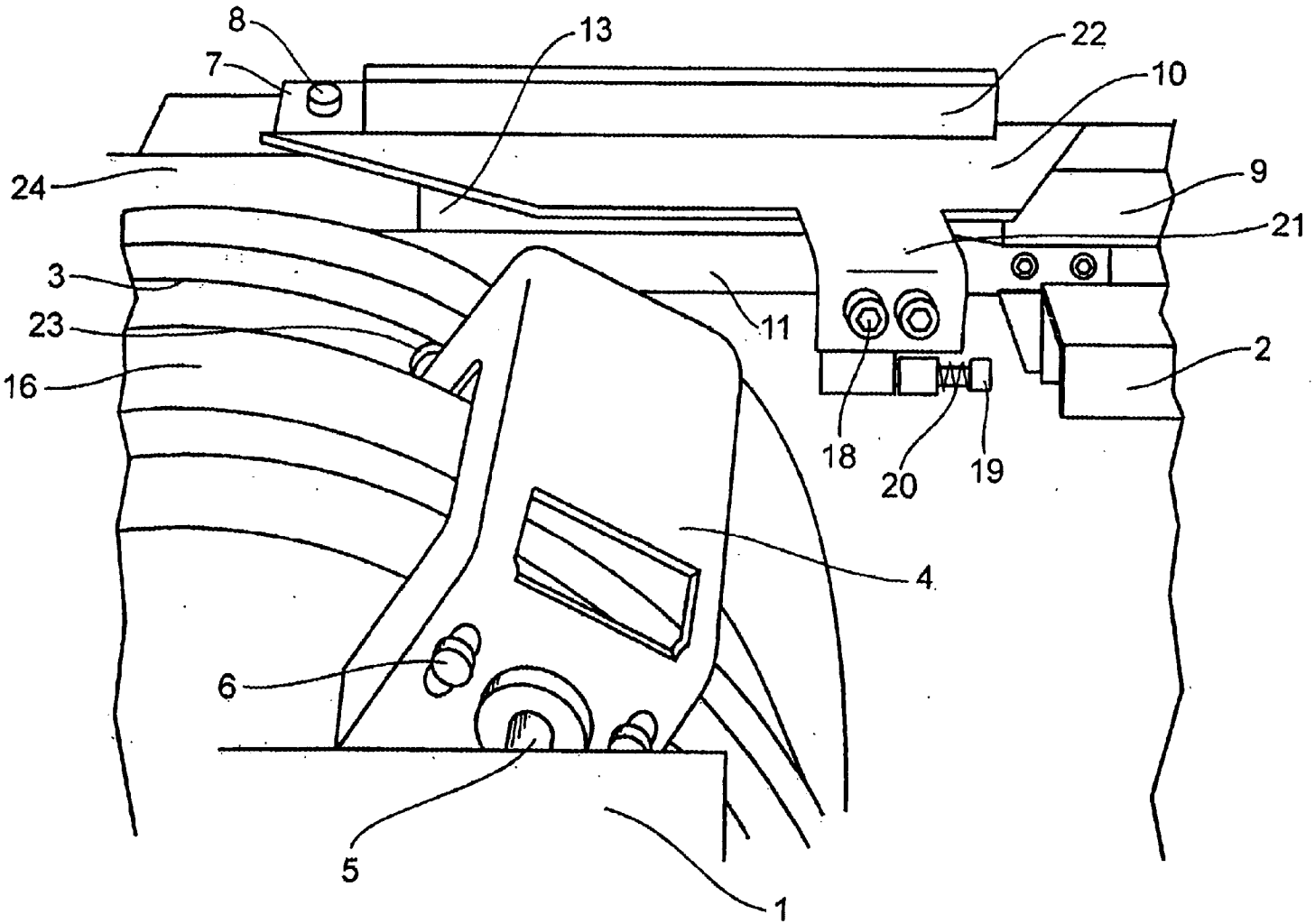
FIG. 14 shows an illustration of the situation of a truck which has entered the curved area of a running surface with the switch not actuated.

In FIG. 13, the truck 4 is has reached the area of the switching piece 47 and thus the vicinity of the switching point 9, which has caused a pivoting of the area of the running surface 10. The truck 4 can therefore run the panel 1 farther over the running surface 10. These illustrations show that the switch is always actuated by every truck, which means that after the truck 4 with the corresponding guide roller leaves, the running surface 10 pivots back out of the area of the running surfaces. Consequently, it is also guaranteed that for example with a truck, the guide roller of which is intended to run in the curved area of the runner rail 16, the runner roller does not collide with the pivoted portion of the running surface.

Figure 15:
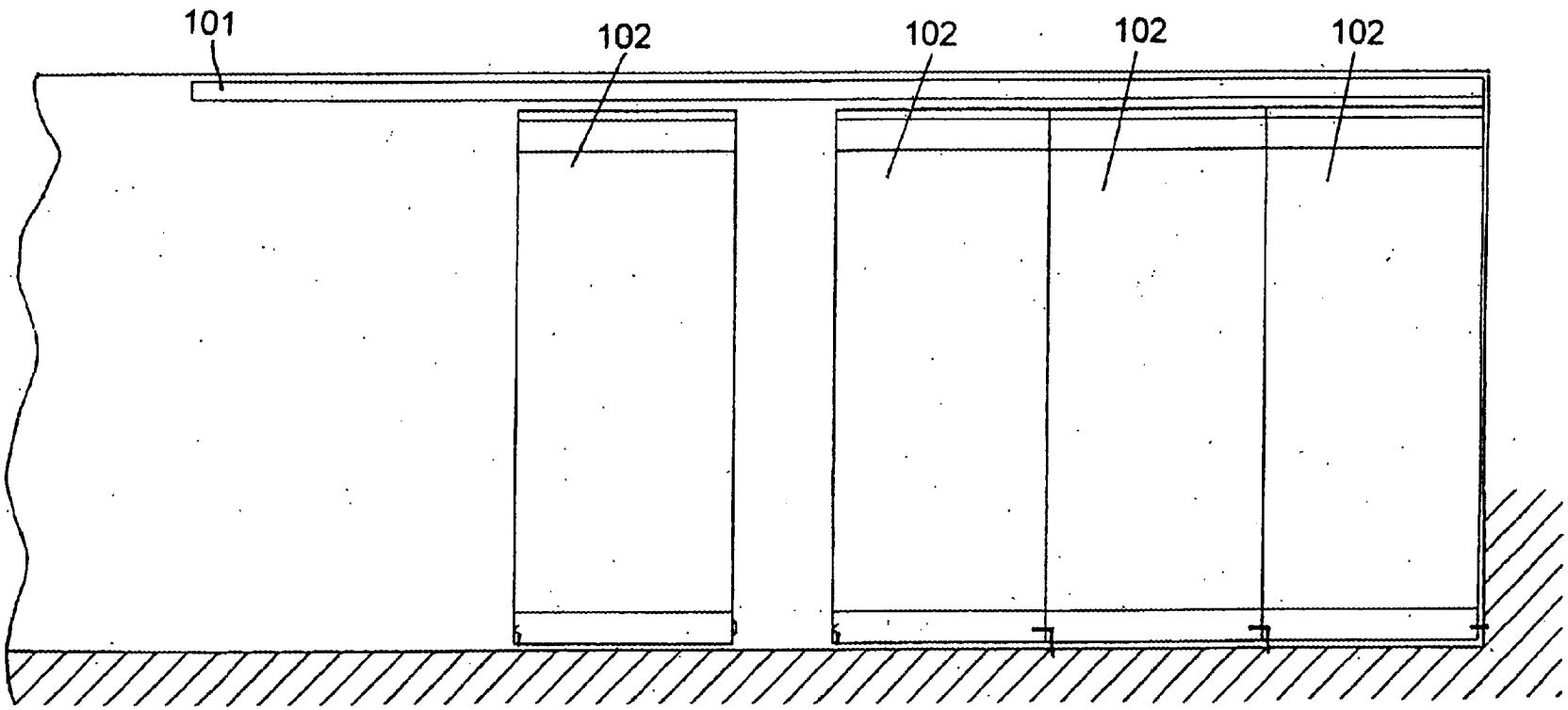
FIG. 15 shows a movable panel system according to at least one possible embodiment of the present invention.

FIG. 15 shows a movable panel system according to at least one possible embodiment of the present invention. Movable panels 102 are suspended from a rail structure 101. The panels 102 can be individually moved either automatically or manually along the rail structure 101. More than one panel 102 can be moved simultaneously.

Figure 16:
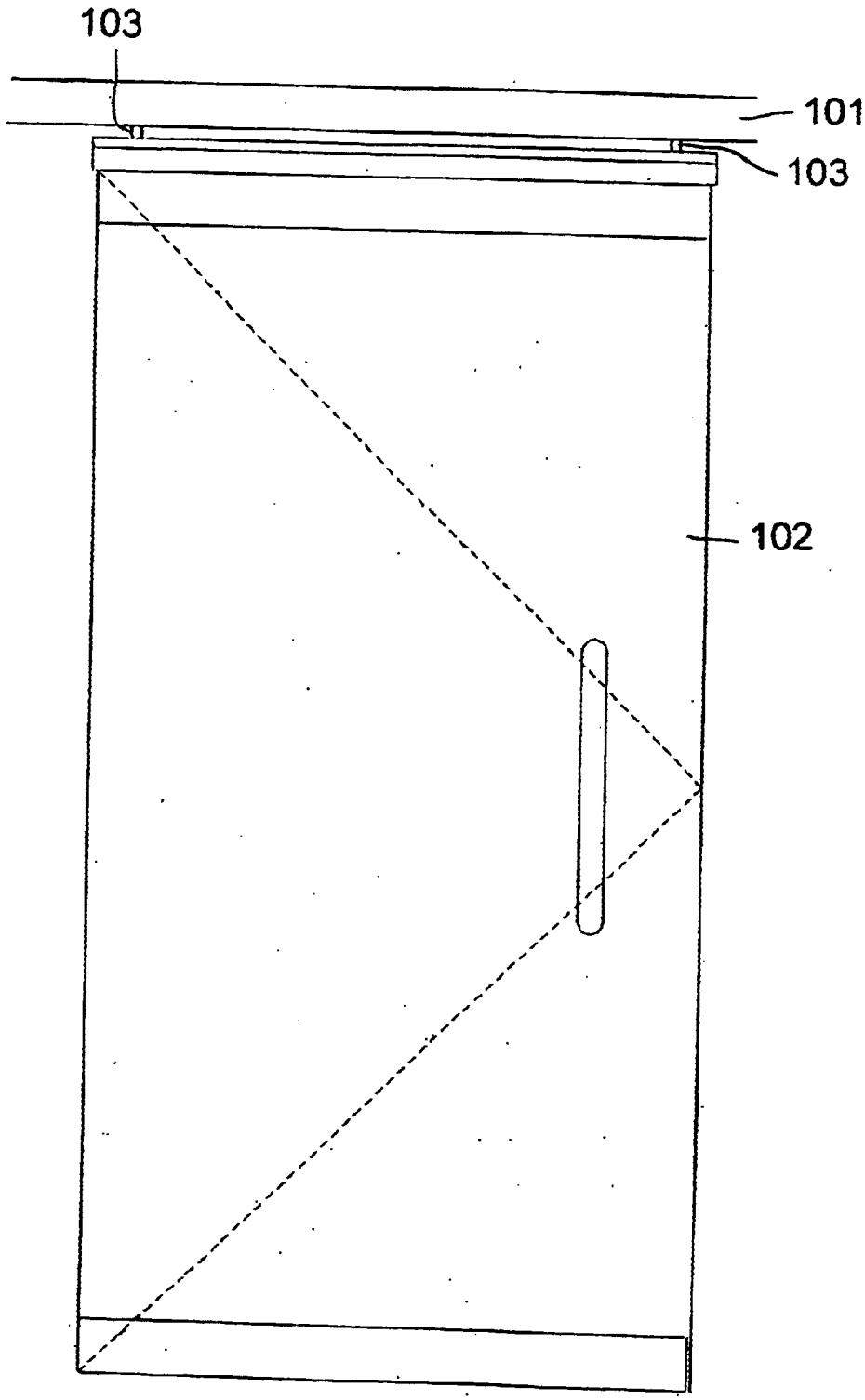
FIG. 16 shows a view of a panel for the movable panel system in FIG. 16.

FIG. 16 shows an individual panel 102 of the movable panel system. The panel 102 is suspended from the rail structure 101 by truck arrangements 103. In this particular embodiment, the panel 102 has two truck arrangements 103 supporting it in a movable manner on rail structure 101.

To further explain, the guide roller 23 of the truck 4 is placed in one of two positions on the upper portion of the truck 4. If the truck 4 is to travel along a particular portion of the runner rail or track 2, the guide roller 23 is placed in a position on the truck 4 such that it does or does not actuate the track-switching arrangement during travel along the track. In an additional possible embodiment, any type of projection or structure could be connected to the truck 4 in place of or in conjunction with the guide roller 23 to actuate a switch. For example, a projecting bar or other extension could be attached to project from the truck 4. The projecting bar could be positioned to contact the switching points 9, 24 during travel to actuate the junction in the runner rail 2 to permit the truck 4 to travel along the path made available by the actuation of the switch. On trucks 4 where it is not desired to actuate the switch, the projecting device would not be attached.

To further explain, in different configurations of a movable wall or partition system, it may become necessary to move various panels to different positions on a single track or guide rail 101. In at least one embodiment of the present invention, there is a junction area on the track or runner rail. At the junction area, the track essentially can split off in two sections, preferably a straight section 2 and a curved section 16 that curves away from the straight section 2. The junction can permit at least one panel 1 to be moved on the curved section 16, while permitting at least one other panel to move on the straight section 2. In at least one embodiment, the straight section 2 is separated by a gap from the main track 101. The main track 101 continues into the curved section 16 without interruption. In this configuration, the panels 1 therefore will always travel along the curved path 16 because the straight path 2 is inaccessible due to the gap. To make the straight section 2 accessible for travel by the panels, a pivoting track portion 10 is attached to the guide rail at the gap. The pivoting track portion 10 can be positioned to be pivoted to fill the gap, thus bridging the gap between the straight section 2 and the main track 101. This design is advantageous because only one pivoting track portion 10 is necessary to permit panels to travel on either section.

To differentiate between the panels 1 that continue along the straight path 2 and the panels that move along the curved path 16, the trucks 4 of the corresponding panel 1 may be coded. This means that the trucks 4 have a configuration that determines along which path they and their corresponding panels will travel. For example, the trucks 4, as discussed above, may have guide rollers 23 that serve to guide the truck 4 along the guide rail. The guide rollers 23 can be positioned to either contact or not contact the track-switching arrangement. For example, if a panel 1 is designated as being one that is to travel on the straight section 2 via the pivoting track portion 10, the guide roller 23 of the truck 4 of that panel 1 is positioned on the truck 4 so that it will contact the track-switching arrangement. When the guide roller 23 contacts the track-switching arrangement during travel of the panel 1, the pivoting track portion 10 pivots into alignment with the straight section 2 and the main track 101 to connect the two. The truck 4 then is able to travel on the pivoting track portion 10 and into the straight section 2. After the truck 4 leaves the pivoting track portion 10, the pivoting track portion 10 returns to its position of disengagement from the straight section 2 and the main track 101. On the other hand, if a panel 1 is designated as being one that is to travel along the curved section 16, the guide roller 23 is positioned on the truck 4 so as to not contact the track-switching arrangement. The truck 4 will therefore pass by the track-switching arrangement without actuating it and continue traveling on the curved section 16. This type of arrangement also works when panels 1 are traveling from the straight section 2 or the curved section 16 to the main track 101.

To further explain, the track-switching arrangement can be connected to the pivoting track portion 10. The track-switching arrangement has a switching or contact piece 47 that can be physically contacted by the guide roller 23. In one possible embodiment of the present invention, the guide roller 23 presses against the switching piece 47 as it rolls along to displace the switching piece 47 from its normal position. By displacing the switching piece 47, a first connecting piece 43 connected to the switching piece 47 is also displaced. The first connecting piece 43 can be connected to a second connecting piece 29 which is positioned essentially parallel to and below the first connecting piece 43. The pivoting track portion 10 is connected to each of the connecting pieces 29, 43 by a corresponding pivoting joint 19, 25. When the first connecting piece 43 is displaced, it in turn can displace an end of the pivoting track portion 10. By displacing the end of the pivoting track portion 10, the pivoting track portion 10 is caused to pivot about the pivoting connection 19 in the second connecting piece 29 in a lever-like movement. The running surface of the pivoting track portion 10 is thus pivoted into alignment with the running surface of the straight section 2 and the main track 101. After the guide roller 23 and truck 4 exit the pivoting track portion 10, they cease to engage the switching piece 47. The connecting pieces 29, 43 can be biased with a spring or other biasing arrangement to apply a force to move the connecting pieces 29, 43. After the guide roller 23 disengages from the switching piece 47, the biasing force moves the connecting pieces 29, 43 and thus the pivoting track piece 10 back out of alignment with the straight section 2 and the main track 101.

In another possible embodiment of the present invention, the movable track piece 10 may be either pivotable or translatable. The track piece 10 may be moved into position by pivoting, as discussed above, or it may be moved into position by a translating motion.

One feature (or aspect) of an embodiment of the invention resides broadly in a runner rail with a movable wall that consists of a plurality of panels (1), each panel (1) of which is mounted by means of at least one suspension device (5, 6) having a guide roller (32) associated with a runner rail (2, 16) so that it can move in the runner rail (2, 16), with at least one running surface (26), on which the runner rollers (48) lie, with lateral guidance means for the suspension device (5, 6) or parts thereof, by which the runner rollers (48) are held in the running surface (26) in the direction of movement, with at least one junction at which the suspension device(5, 6) of the panel (1) is steered in a predetermined manner into a direction of movement on the running surface (26), characterized by the fact that the truck (4) has only one carrier roller (48) and one guidance roller (23, 32), and that the guide roller (23, 32) actuates a junction in the form of a switchable switch which has a pivoting running surface (10) for the carrier roller (48).

Another feature (or aspect) of an embodiment of the invention resides broadly in a runner rail, characterized by the fact that the guide roller (23, 32) actuates a switching piece (47) to pivot a running surface (10).

Yet another feature (or aspect) of an embodiment of the invention resides broadly in a runner rail, characterized by the fact that the switching piece (13) consists of a rigid bent intermediate piece (13), attached to the ends of which are flexible switching points (9) and (24).

Still another feature (or aspect) of an embodiment of the invention resides broadly in a runner rail, characterized by the fact that the flexibility is achieved by spring steel sheets (7) and (14).

A further feature (or aspect) of an embodiment of the invention resides broadly in a runner rail, characterized by the fact that the switching piece (47) is connected to a connecting piece (11, 43), which executes a relative movement at right angles to the runner rail (2).

Another feature (or aspect) of an embodiment of the invention resides broadly in a runner rail, characterized by the fact that on the end of the connecting piece (43) there are spacers (35) and (27) that can be rotated in the manner of a parallelogram and which are simultaneously mounted rotationally on a connecting piece (11), which is fastened in a stationary fashion to the runner rails (2) and (16).

Yet another feature (or aspect) of an embodiment of the invention resides broadly in a runner rail, characterized by the fact that the spacer (27) is longer than the spacer (35) and on its free end holds the pivoting running surface (10).

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

| AT LEAST PARTIAL LIST OF NOMENCLATURE |
|---|
| 1 Panel |
| 2 Straight runner rail |
| 3 First guide channel |
| 4 Truck |
| 5 Panel suspension device |
| 6 Panel fastener |
| 7 Spring steel sheet |
| 8 Fastener |
| 9 Switching point |
| 10 Pivoting running surface |
| 11 Connecting piece |
| 12 Fastener |
| 13 Intermediate piece |
| 14 Spring steel sheet |
| 15 Fastener |
| 16 Curved runner rail |
| 17 Fastener |
| 18 Fastener |
| 19 Fastener and force adjustment mechanism |
| 20 Spring |
| 21 Holder |

-continued

| AT LEAST PARTIAL LIST OF NOMENCLATURE |
|---|
| 22 Bent portion |
| 23 Guide roller |
| 24 Switching point |
| 25 Connecting bolt and force adjustment mechanism |
| 26 Running surface |
| 27 Spacer |
| 28 Connecting bolt |
| 29 Parallel piece |
| 30 Second guide channel |
| 31 Bevel |
| 32 Guide roller |
| 33 Bevel |
| 34 Bent portion |
| 35 Spacer |
| 36 Bent portion |
| 37 Fastening hole |
| 38 Beveled portion |
| 39 Rounded portion (entrance area) |
| 40 First leg |
| 41 Second leg |
| 42 Fastening hole |
| 43 Connecting piece |
| 44 Direction of movement |
| 45 Direction of movement |
| 46 Fastening hole |
| 47 Switching piece |
| 48 Load-bearing roller |
| 49 Recess |
| 50 Connection |
| 51 Stationary pivot |
| 52 Movable pivot |

What is claimed is:

1. A movable wall system for use in buildings, said movable wall system comprising:

a plurality of movable panels;

a runner rail structure;

each of said panels comprising at least one suspension device to suspending each of said panels from said runner rail structure;

each of said suspension devices comprising a runner roller;

said runner rollers being configured and disposed to run on said runner rail structure to permit movement of each of said panels;

said runner rail structure comprising:

a first track section;

a second track section;

a third track section;

said first track section being joined with said second track section at a junction area;

said first track section being separated from said third track section by a gap said junction area;

a track-switching arrangement being configured and disposed to be actuated to bridge said gap to permit said at suspension devices to travel between said first track section and said third track section; and said track-switching arrangement comprising:

a movable track portion being pivotable about an axis which is generally parallel to a longitudinal axis of said first track section and a longitudinal axis of said third track section of:

said movable track portion being configured and disposed to be moved into said gap to connect said first track section and said third track section, and to bypass said second track section; and a mechanical switch being configured and disposed to be actuated to move said movable track portion into said gap; and said each of said suspension devices comprising a contact structure;

said contact each of structures being one of:

disposed to contact and actuate said mechanical switch upon said suspension device entering said junction area to permit said suspension device to travel between said first track section and said third track section; and disposed not to contact said mechanical switch upon said suspension device entering said junction area.

2. The movable wall system according to claim 1, wherein said mechanical switch comprises a rigid bent intermediate piece having flexible switching points attached thereto.

3. The movable wall system according to claim 2, wherein the flexibility of said switching points is achieved by spring steel sheets.

4. The movable wall system according to claim 2, wherein said intermediate piece is connected to a first connecting piece, which is configured to execute a relative movement with respect to said runner rail structure.

5. The movable wall system according to claim 4, wherein:

said track switching arrangement comprises a first spacer and a second spacer;

said first connecting piece has a first end and a second end opposite said first end;

said mechanical switch is connected to said first end of said first connecting piece;

said first spacer and said second spacer each are rotationally connected to said second end of said first connecting piece said first spacer and said second spacer are configured and disposed to be parallel with respect to one another;

said track switching arrangement further comprises a second connecting piece disposed parallel to said first connecting piece;

said second connecting piece is connected to said first track section and said third track section;

said first spacer and said second spacer each are rotationally connected to said second connecting piece said; and said first connecting piece, said second connecting piece, said first spacer, and said second spacer are configured and disposed to together define a parallelogram.

6. The movable wall system according to claim 5, wherein the first spacer is longer than the second spacer and has a free end holding the movable track portion.

7. The movable wall system according to claim 1, wherein said mechanical switch comprises an intermediate piece connected to a first connecting piece, which is configured to execute a relative movement with respect to said runner rail structure.

8. The movable wall system according to claim 7, wherein:

said track switching arrangement comprises a first spacer and a second spacer;

said first connecting piece has a first end and a second end opposite said first end;

said mechanical switch is connected to said first end of said first connecting piece;

said first spacer and said second spacer each are rotationally connected to said second end of said first connecting piece said first spacer and said second spacer are configured and disposed to be parallel with respect to one another;

said track switching arrangement further comprises a second connecting piece disposed parallel to said first connecting piece;

said second connecting piece is connected to said first track section and said third track section;

said first spacer and said second spacer each are rotationally connected to said second connecting piece; and said first connecting piece, said second connecting piece, said first spacer, and said second spacer are configured and disposed to together define a parallelogram.

9. The movable wall system according to claim 8, wherein the first spacer is longer than the second spacer and has a free end holding the movable track portion.

10. A movable wall system for use in buildings, said movable wall system comprising:

a plurality of movable panels;

a runner rail structure;

each of said panels comprising at least one suspension device to suspending each of said panels from said runner rail structure;

each of said suspension devices comprising a single runner roller and also a single contact structure separate from said runner roller;

said runner rollers being and disposed to run on said runner rail structure to permit movement of each of said panels;

said runner rail structure comprising:

a first track section;

a second track section;

a third track section;

a track-switching arrangement being disposed to be actuated to suspend said suspension devices as said suspension devices travel between said first track section and said third track section; and said track-switching arrangement comprising:

a movable track portion being pivotable about an axis which is generally parallel to a longitudinal axis of said first track section and a longitudinal axis of said third track section;

said movable track portion being disposed to be moved into a position to suspend said suspension devices as said suspension devices travel between said first track section and said third track section; and a mechanical switch being configured and disposed to be actuated to move said movable track portion into said position; and each said contact structure is configured to be disposed in either:

a first position in said suspension device to permit said contact structure to contact and actuate said mechanical switch said at least one; or a second position in said suspension device to permit said contact structure to not contact said mechanical switch.

11. The movable wall system according to claim 10, wherein:

said mechanical switch comprises a rigid bent intermediate piece having flexible switching points attached thereto;

said flexible switching points comprise flexible spring steel sheets;

said mechanical switch is connected to a first connecting piece, which is configured to execute a relative movement with respect said runner rail structure;

said track switching arrangement comprises a first spacer and a second spacer;

said first connecting piece has a first end and a second end opposite said first end;

said mechanical switch is connected to said first end of said first connecting piece;

said first spacer and said second spacer each are rotationally connected to said second end of said first connecting piece said first spacer and said second spacer are configured and disposed to be parallel with respect to one another;

said track switching arrangement comprises a second connecting piece disposed parallel to said first connecting piece;

said second connecting piece is connected to said first track section and said third track section;

said first spacer and said second spacer each are rotationally connected to said second connecting piece;

said first connecting piece, said second connecting piece, said first spacer, and said second spacer are configured and disposed together to form a parallelogram;

said first spacer is longer than said second spacer;

said first spacer has a first end and a second end opposite said first end of said first spacer;

said first spacer is connected to said first and second connecting pieces at said first end of said first spacer; and said movable track portion is connected to said second end of said first spacer.

12. A movable wall system for use in buildings, said movable wall system comprising:

a plurality of movable panels;

a runner rail structure;

each of said panels comprising at least one suspension device to suspending each of said panels from said runner rail structure;

each said suspension device comprising:

a single runner roller being disposed to run on said runner rail structure to permit movement of its corresponding one of said panels; and a single guide roller separate from said runner roller and being disposed to guide said suspension device in said runner rail structure;

said runner rail structure comprising:

a first track section;

a second track section;

a third track section;

a track-switching arrangement being disposed to be actuated by said guide rollers to suspend said suspension devices as said suspension devices to travel between said first track section and said third track section; and said track-switching arrangement comprising a movable track portion, being pivotable about an axis which is generally parallel to a longitudinal axis of said first track section and a longitudinal axis of said third track section;

said movable track portion being disposed to be moved into a position to suspend said suspension devices as said suspension devices travel between said first track section and said third track section.

13. The movable wall system according to claim 12, wherein said track switching arrangement comprises a mechanical switch being configured and disposed to be contacted by said guide rollers to actuate said track switching arrangement.

14. The movable wall system according to claim 13, wherein said guide rollers are each is configured to be disposed in either:

a first position in said suspension device to permit said guide roller to contact and actuate said mechanical switch to permit said suspension device to travel between said first track section and said third track section; or a second position in said suspension device to permit said guide roller to not contact said mechanical switch.

15. The movable wall system according to claim 14, wherein said mechanical switch comprises a rigid bent intermediate piece having flexible switching points attached thereto.

16. The movable wall system according to claim 15, wherein said mechanical switch is connected to a first connecting piece, which is configured to execute a relative movement at with respect to said runner rail structure.

17. The movable wall system according to claim 16, wherein:

said track switching arrangement comprises a first spacer and a second spacer;

said first connecting piece has a first end and a second end opposite said first end;

said mechanical switch is connected to said first end of said first connecting piece;

said first spacer and said second spacer each are rotationally connected to said second end of said first connecting piece;

said first spacer and said second spacer are configured and disposed to be parallel with respect to one another;

said track switching arrangement further comprises a second connecting piece disposed parallel to said first connecting piece;

said second connecting piece is connected to said first track section and said third track section;

said first spacer and said second spacer each are rotationally connected to said second connecting piece; and said first connecting piece, said second connecting piece, said first spacer, and said second spacer are configured and disposed together to form a parallelogram.

18. The movable wall system according to claim 17, wherein:

said first spacer is longer than said second spacer;

said first spacer has a first end and a second end opposite said first end of said first spacer;

said first spacer is connected to said first and second connecting pieces at said first end of said first spacer; and said movable track portion is connected to said second end of said first spacer.

19. The movable wall system according to claim 15, wherein said flexible switching points comprise flexible spring steel sheets.

20. The movable wall system according to claim 14, wherein said mechanical switch is connected to a connecting piece, which is configured to execute a relative movement with respect to said runner rail structure.

* * * * *

UNITED STATES PATENT AND TRADEMARK OFFICE

CERTIFICATE OF CORRECTION

PATENT NO. : 6,848,214 B2
DATED : February 1, 2005
INVENTOR(S) : Markus Bischof and Stefan Rechsteiner It is certified that error appears in the above-identified patent and that said Letters Patent is hereby corrected as shown below:

Title page, Item [54] and Column 1, line 3,
Title, delete "TRACKING-" and insert -- TRACK- --.

Title page,
Item [56], References Cited, insert the following:
-- U.S. PATENT DOCUMENTS

| | | |
|---|---|---|
| US-3,241,197 | 03-1966 | Gogerty, Henry L. |
| US-745,645 | 12-1903 | Mundy |
| US-5,542,214 | 08-1996 | Buening, Dennis J. |
| US-5,230,123 | 07-1993 | Williams et al. |
| US-4,555,828 | 12-1985 | Matimura, Tugumi |
| US-2,657,436 | 11-1953 | Fairhurst, John T. et al. |
| US-4,642,947 | 02-1987 | Dickson, Wesley B. |
| US-3,358,319 | 12-1967 | Hillenbrand, William A. et al. |
| US-3,279,123 | 10-1966 | John Genison |
| US-2,904,852 | 09-1959 | Davis, Charles F. --. |

Item [57], ABSTRACT, delete the entire paragraph and insert the following:
-- Movable wall system having a plurality of panels, each of which is mounted and supported on a runner rail by at least one suspension device. Each suspension device has a runner roller to move and support each panel on the runner rail. Each suspension device also has a guide roller to guide and hold the suspension device and runner roller on the runner rail in the direction of movement. The runner rail has at least one junction at which the suspension device of each panel is steered in a predetermined manner along a desired path of travel on the running surface. The guide roller actuates a junction in the form of a switchable switch which has a pivoting running surface for the carrier roller. --.

Column 8,
Line 9, after "FIG.", delete "4;" and insert -- 4, --.

Column 11,
After line 39, insert the following paragraph:
-- The corresponding foreign and international patent publication applications, namely, Federal Republic of Germany Application No. 100 24 580.3, filed on May 19, 2000, having inventors Markus BISCHOF and Stefan RECHSTEINER, and DE-OS 100 24 580.3 and DE-PS 100 24 580.3, and International Application No. PCT/EP01/05730, filed on May 18, 2001, having inventors Markus BISCHOF and Stefan RECHSTEINER, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein. --.

UNITED STATES PATENT AND TRADEMARK OFFICE

CERTIFICATE OF CORRECTION

PATENT NO. : 6,848,214 B2
DATED : February 1, 2005
INVENTOR(S) : Markus Bischof and Stefan Rechsteiner It is certified that error appears in the above-identified patent and that said Letters Patent is hereby corrected as shown below:

Column 12,
Line 37, after "device" delete "to".
Line 41, after "being" delete "configured and".
Line 51, after "gap" insert -- at --.
Line 60, after "track", delete "section of:" and insert -- section; --.

Column 13,
Line 1, before the second occurrence of "said", delete "said each of" and insert -- each of said --.
Line 3, before "structures", delete "said contact each of" and insert -- each of said contact --.
Lines 31 and 65, after "piece" insert -- ; --.
Line 41, after "piece" delete "said".

Column 14,
Line 20, after "device" delete "to".
Line 25, after "being" delete "and".
Line 53, after "switch" delete "said at least one".

Column 15,
Line 10, after "piece" insert -- ; --.
Line 38, after "device" delete "to".
Line 53, after the second occurrence of "devices" delete "to".

Column 16,
Line 22, after "movement" delete "at".

Signed and Sealed this

Twenty-seventh Day of September, 2005

JON W. DUDAS
*Director of the United States Patent and Trademark Office*